United States Patent [19]

Woodward, Jr. et al.

[11] Patent Number: 4,510,501

[45] Date of Patent: Apr. 9, 1985

[54] BROADBAND LOOP ANTENNA WITH LOW WIND RESISTANCE

[75] Inventors: Oakley M. Woodward, Jr., Princeton, N.J.; Milton P. Greaves, Jr., Levittown, Pa.

[73] Assignee: RCA Corporation, New York, N.Y.

[21] Appl. No.: 496,311

[22] Filed: May 19, 1983

[51] Int. Cl.[3] ..... H01Q 11/14

[52] U.S. Cl. ..... 343/742; 343/797; 343/835; 343/859

[58] Field of Search ..... 343/741-744, 343/797, 834-839, 859

[56] References Cited

U.S. PATENT DOCUMENTS

| | | | |
|---|---|---|---|
| 2,369,556 | 2/1945 | Gamet | 343/803 |
| 4,184,163 | 1/1980 | Woodward | 343/742 |

*Primary Examiner*—Eli Lieberman

*Attorney, Agent, or Firm*—Eugene M. Whitacre; Henry I. Steckler; Thomas H. Magee

[57] ABSTRACT

An antenna for CP signals uses a reflector, such as a truncated pyramid. Feed tubes, which act as a balun extend from the pyramid. Four truncated square loops are coupled to the feed means. The truncation results in a smaller radome being used and hence smaller wind resistance. A feed strap has a capacitance hat for a better match.

14 Claims, 6 Drawing Figures

Fig. 1a
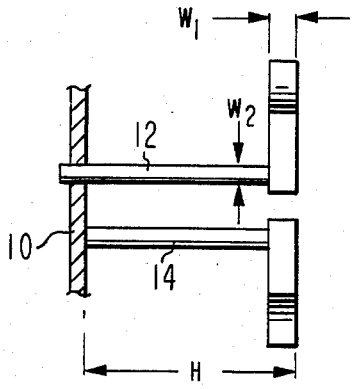
Fig. 1b
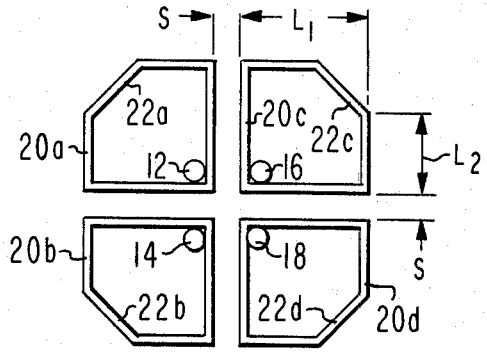
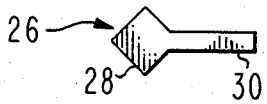
Fig. 2a
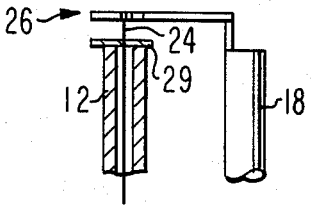
Fig. 2b
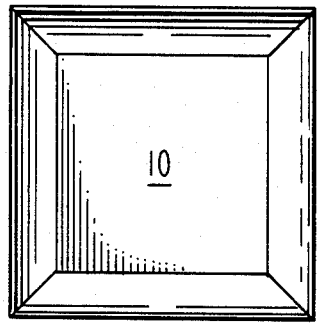
Fig. 3a
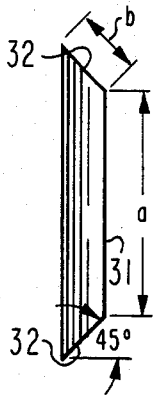
Fig. 3b

BROADBAND LOOP ANTENNA WITH LOW WIND RESISTANCE

BACKGROUND OF THE INVENTION

The present invention relates to broadband CP (circularly polarized) loop antennas, and more particularly to such antennas as used in television broadcasting.

A broadband CP antenna using four circular or square loops for use over a 1.24:1 frequency range (TV channels 7 to 13) is shown in U.S. Pat. No. 4,184,163. However a radome, which is normally placed over the antenna for weather protection, may result in unacceptably high wind loading.

It is therefore desirable to provide a broadband CP antenna that has low windloading.

SUMMARY OF THE INVENTION

An antenna comprising a reflector, a feed means extending generally perpendicular from said reflector, and four truncated square loops coupled to said feed means, each of said loops having truncated corners opposite said feed means.

DESCRIPTION OF THE DRAWINGS

FIGS. 1*a* and 1*b* are side and front views respectively of the invention;

FIGS. 2*a* and 2*b* show top and side views respectively of the matching device; and FIGS. 3*a* and 3*b* are front and side views respectively of the reflector.

DETAILED DESCRIPTION

FIGS. 1*a* and 1*b* show a reflector 10 (described in detail below) having four circular balun legs 12, 14, 16 and 18 mounted thereon and each having diameter $W_2$. At the ends of legs 12, 14, 16, and 18 at a distance H from the reflector 10 are mounted approximately square loops 20*a*, 20 *b*, 20 *c* and 20*d* having truncated corners 22*a*, 22*b*, 22*c*, and 22*d* respectively. The untruncated sides of loops 20 have a length $L_1$, while the truncated sides thereof have a straight portion of length $L_2$. The inner sides are spaced by a distance S from each other. Details of the feed system are omitted from FIGS. 1*a* and 1*b* for purposes of clarity, but are shown in FIGS. 2*a* and 2*b*.

FIGS. 2*a* and 2*b* show details of the feed system. A pair of diagonally opposite legs 12 and 18 are shown. Leg 12 has an inner conductor 24 and thus forms a coaxial transmission line which is coupled to the feed (not shown). Conductor 24 is connected to a feed strap 26 comprising an approximately square capacitance hat portion 28 and arm portion 30. Hat 28 is about 1.75 inches on a side for an embodiment for TV channels 7 to 13, and it, together with square flange 29, also 1.75 inches on a side and mounted on the end of leg 12, supplies capacitance needed to match the antenna to the transmission line. Arm 30 is connected to leg 18 and for said embodiment is about 0.4 inches in width. Balun legs 14 and 16 have the same feed system, with either leg 14 or 16 forming the coaxial transmission line. While in FIG. 2*b* arm 30 is shown as being perfectly straight, it will be appreciated that in an actual embodiment one arm 30 is bent at its middle downwards, while the other arm 30 is bent upwards so they do not contact each other.

FIGS. 3*a* and 3*b* show the details of reflector 10 which is in the form of a truncated pyramid having a small base 31 of dimension a and a slant side 32 of length b.

Table I below gives the dimensions in fractions of a wavelength at the center of the frequency band.

TABLE I

| PARAMETER | LINE IMPEDANCE 50Ω | 75Ω |
|---|---|---|
| $L_1$ | 0.173 | 0.173 |
| $L_2$ | 0.09 | 0.09 |
| $W_1$ | 0.036 | 0.036 |
| $W_2$ | 0.023 | 0.023 |
| S | 0.018 | 0.025 |
| H | 0.252 | 0.252 |
| a | 0.7 | 0.7 |
| b | 0.2 | 0.2 |

It will be noted that the only changes required to go from the 50-ohm embodiment to the 75-ohm embodiment are the spacing S between the loops 22 and the capacity at the feed straps.

The performance of an antenna can be characterized by plotting its impedance versus frequency on a Smith chart. Normally for a broadband antenna the operating frequency range forms a loop around the origin on the Smith chart. In general for the present invention, a change in the spacing S moves the impedance loop to the left or to the right (changes resistance) on the Smith Chart, and a change in the capacity moves the loop upward or downward (changes reactance). Thus it is easy to build either 50 or 75 ohm embodiment. A change in L tends to shift the center-band frequency. Changes in H affect the size of the loop.

The SWR stays within 1:15:1 for both 50 and 70 ohm embodiments over a 1.24:1 bandwidth.

Four embodiments in accordance with the present invention, mounted around a square tower and having corresponding elements fed in-phase, gives an azimuth circularity of ±2 dB or less over the 1.24:1 band. This arrangement can comprise one layer of a number of such layers stacked vertically.

It will be noted that since the radome (not shown) covers only the antenna and balun legs, and not the reflector 10, a reduction in its base diameter, and hence wind loading, is achieved by use of the present invention.

It will be appreciated that many other embodiments are possible within the spirit and scope of the invention. For example, many other reflector shapes other than a truncated pyramid can be used, such as a truncated cone for the rearmost reflector portion and a cyclindar joined to the truncated cone as the forward reflector portion. Slight variations in antenna dimension may be required for different reflector shapes. Also other methods than that of hat 28 and flange 29 can be used to provide capacity, such as enlarging the end of the inner conductor of the coaxial transmission near the end of the balun leg remote from reflector 10. Still further, loops 22 can have arcuate shaped truncated portions to reduce the diameter of the base of the randome.

What is claimed is:

1. An antenna comprising a reflector, a feed means extending generally perpendicular from said reflector, and four truncated square loops coupled to said feed means, each of said loops having a truncated corner opposite said feed means.

2. An antenna as claimed in claim 1, wherein said reflector comprises a truncated pyramid.

3. An antenna as claimed in claim 2, wherein said pyramid has a smaller base length of about 0.7 wavelengths at a selected center frequency and a side length of 0.2 wavelengths at said center frequency.

4. An antenna as claimed in claim 1, wherein said feed means comprises a balun.

5. An antenna as claimed in claim 1, wherein said feed means comprises two pairs of tubes.

6. An antenna as claimed in claim 5, wherein said tubes are about 0.023 wavelengths in diameter at a selected center frequency.

7. An antenna as claimed in claim 5, further comprising a pair feed straps, each extending between diagonally opposite pairs of tubes respectively.

8. An antenna as claimed in claim 7, wherein each of said straps comprises an arm and a capacitance hat coupled to said tubes respectively.

9. An antenna as claimed in claim 5, wherein said tubes are about 0.252 wavelengths long at a selected center frequency.

10. An antenna as claimed in claim 1, wherein said loops have a thickness in the direction towards said reflector of about 0.036 wavelengths at a selected center frequency.

11. An antenna as claimed in claim 1, wherein said loops have an untruncated side length of about 0.173 wavelengths at a selected center frequency and a truncated straight side length of about 0.09 wavelengths at said center frequency.

12. An antenna as claimed in claim 1, wherein said loops are spaced from one another about 0.018 at a selected center frequency.

13. An antenna as claimed in claim 1, wherein said loops are spaced from one another about 0.025 wavelengths at a selected center frequency.

14. An antenna comprising a reflector; four tubes extending from said reflector; two pairs of feed straps coupled to diagonally opposite tubes, each of said straps having a capacity hat at one end thereof; and four truncated square loops respectively coupled to said tubes, each of said loops having a truncated corner opposite side tubes.

* * * * *